US010446944B1

(12) United States Patent
Beckert et al.

(10) Patent No.: US 10,446,944 B1
(45) Date of Patent: Oct. 15, 2019

(54) DEVICES, SYSTEMS, AND METHODS FOR INCREASING TERMINAL ELECTRICAL CONTACT

(71) Applicant: Littelfuse, Inc., Chicago, IL (US)

(72) Inventors: James J. Beckert, Rolling Meadows, IL (US); Jim Albrecht, Chicago, IL (US)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 16/138,922

(22) Filed: Sep. 21, 2018

(51) Int. Cl.
*H01R 4/48* (2006.01)
*H01R 43/00* (2006.01)

(52) U.S. Cl.
CPC ..... *H01R 4/48* (2013.01); *H01R 43/00* (2013.01)

(58) Field of Classification Search
CPC ..... H01R 4/48; H01Q 1/084; H01Q 1/243; B23K 20/10; B60R 16/0238
USPC ..... 439/883
See application file for complete search history.

(56) References Cited

U.S. PATENT DOCUMENTS 5,715,135 A * 2/1998 Brussalis ..... B60R 16/0238 361/622
7,840,243 B2 * 11/2010 Hirai ..... H01Q 1/243 379/428.01
8,634,200 B2 * 1/2014 Togashi ..... H01Q 1/243 361/730
2001/0051510 A1 * 12/2001 Nakamura ..... H01Q 1/084 455/575.3
2003/0100228 A1 * 5/2003 Bungo ..... B23K 20/10 439/701

* cited by examiner

*Primary Examiner* — Jean F Duverne

(57) ABSTRACT

A system for increasing terminal electrical contact may include a first tuning fork terminal extendable on a first plane, and may include a first prong and a second prong both extending from a joined first end to respective distal ends and may form a first gap therebetween. The system may further include a second tuning fork terminal extendable on a second plane and may include a third prong and a fourth prong both extending from a joined second end to respective distal ends and may form a second gap therebetween. The first plane and the second plane may be substantially perpendicular. The distal ends of the first and second prongs may be configured to contact the second end of the second tuning fork, and the distal ends of the third and fourth prongs may be configured to contact the first end of the first tuning fork.

20 Claims, 7 Drawing Sheets

DEVICES, SYSTEMS, AND METHODS FOR INCREASING TERMINAL ELECTRICAL CONTACT

FIELD OF THE DISCLOSURE

Embodiments of the present disclosure relate generally to terminal electrical contacts, and more particularly to electrical contacts in cartridge fuses.

BACKGROUND OF THE DISCLOSURE

Fuses in automotive applications, such as cartridge fuses, may include fuse terminals having a plurality of fingers, or prongs. A pair of terminals may typically be incorporated into a fuse cartridge for two contact points with the circuit board when connected. In some applications, the current-carrying capacity of the terminal limits the fuse ratings that may be designed or applied. However, connecting multiple fuses may take up too much space and increase cost of parts and possible points of failure.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

According to an exemplary embodiment of the present disclosure, a system for increasing terminal electrical contact may include a first tuning fork terminal end extendable on a first plane which may include a first prong and a second prong both extending from a joined first end to respective distal ends and forming a first gap therebetween. A second tuning fork terminal end may be extendable on a second plane which may include a third prong and a fourth prong both extending from a joined second end to respective distal ends and forming a second gap therebetween. The first plane and the second plane may be substantially perpendicular to each other. The distal ends of the first and second prongs may be configured to contact the second end of the second tuning fork. The distal ends of the third and fourth prongs may be configured to contact the first end of the first tuning fork.

According to an exemplary embodiment of the present disclosure, a method for increasing terminal electrical contact may include attaching a first tuning fork terminal to a second tuning fork terminal. The first tuning fork terminal may include a first prong and a second prong both extending from a joined first end to respective distal ends to form a first gap therebetween. The second tuning fork terminal may include a third prong and a fourth prong both extending from a joined second end to respective distal ends to form a second gap therebetween. The first and second gaps may be configured such that the first tuning fork terminal is insertable substantially perpendicular with respect to the second tuning fork terminal. The distal ends of the first and second prongs may be configured to contact the second end of the second tuning fork. The distal ends of the third and fourth prongs may be configured to contact the first end of the first tuning fork.

In various of the foregoing and other embodiments of the present disclosure, the first gap at the distal ends of the first and second prongs may have a width smaller than a thickness of the second tuning fork. The second gap at the distal ends of the third and fourth prongs may have a width smaller than a thickness of the first tuning fork. The first prong and the second prong may be flexible to deflect away from each other such that the first gap is enlarged for receiving the second tuning fork terminal. A first spring force may maintain the second tuning fork terminal in the first gap between the first and second prongs. The third prong and the second prong may be flexible to deflect away from each other such that the second gap is enlarged for receiving the first tuning fork terminal. A second spring force may maintain the first tuning fork terminal in the second gap between the third and fourth prongs. A first protrusion may be disposed on a distal end of the first prong and may extend towards the first gap. A second protrusion may be disposed on the distal end of the second prong and may extend toward the first gap. A third protrusion may be disposed on the distal end of the third prong and may extend toward the second gap. A fourth protrusion may be disposed on the distal end of the second prong and may extend toward the second gap. A distance from a centerline of the first gap to the protrusions of the first and second prongs for contacting the second tuning fork may be different from a distance from a centerline of the second gap to the protrusions of the third and fourth prongs for contacting the first tuning fork. Contact between the first tuning fork and the second tuning fork may be staggered during insertion. The first prong, second prong, third prong, fourth prong, or combinations thereof, may have a constant width. The first prong, second prong, third prong, fourth prong, or combinations thereof, may have a variable width.

BRIEF DESCRIPTION OF THE DRAWINGS

By way of example, specific embodiments of the disclosed device will now be described, with reference to the accompanying drawings, in which.

DETAILED DESCRIPTION

Figure 1:
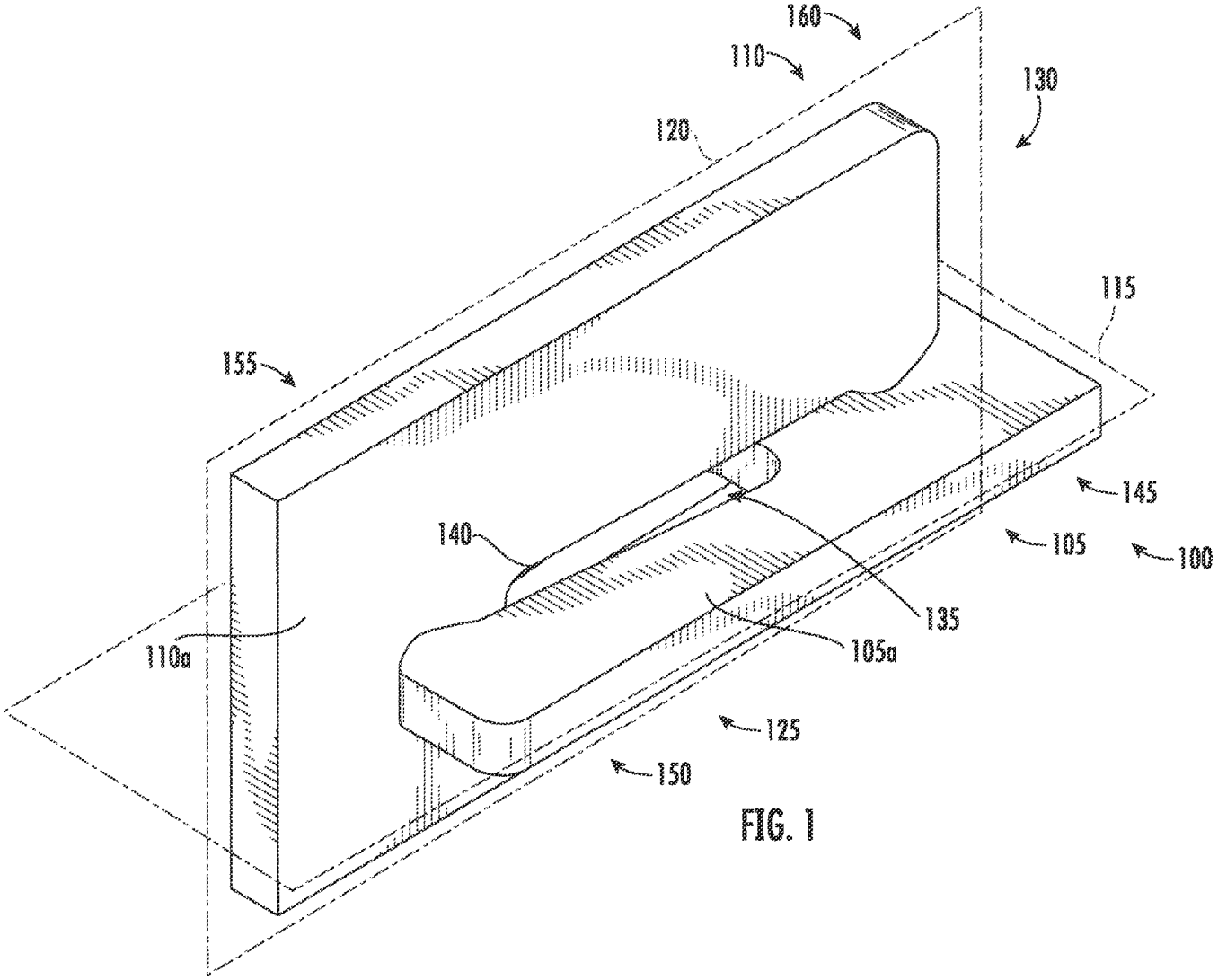
FIG. 1 is a perspective view illustrating an exemplary embodiment of a terminal system in accordance with the present disclosure.
Figure 2A:
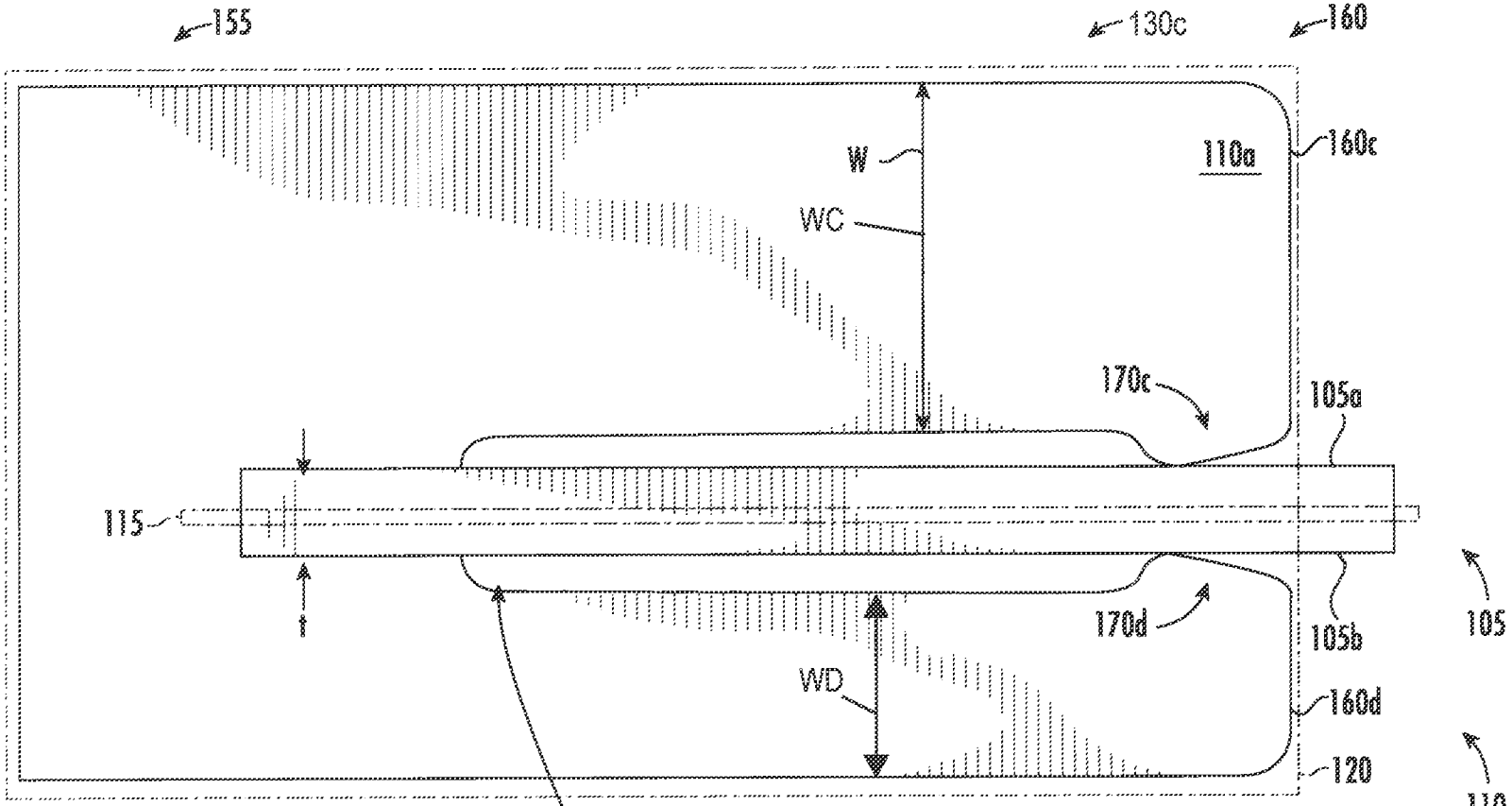
FIGS. 2A-2B are front and back views illustrating an exemplary embodiment of a second terminal end shown in FIG. 1.
Figure 2B:
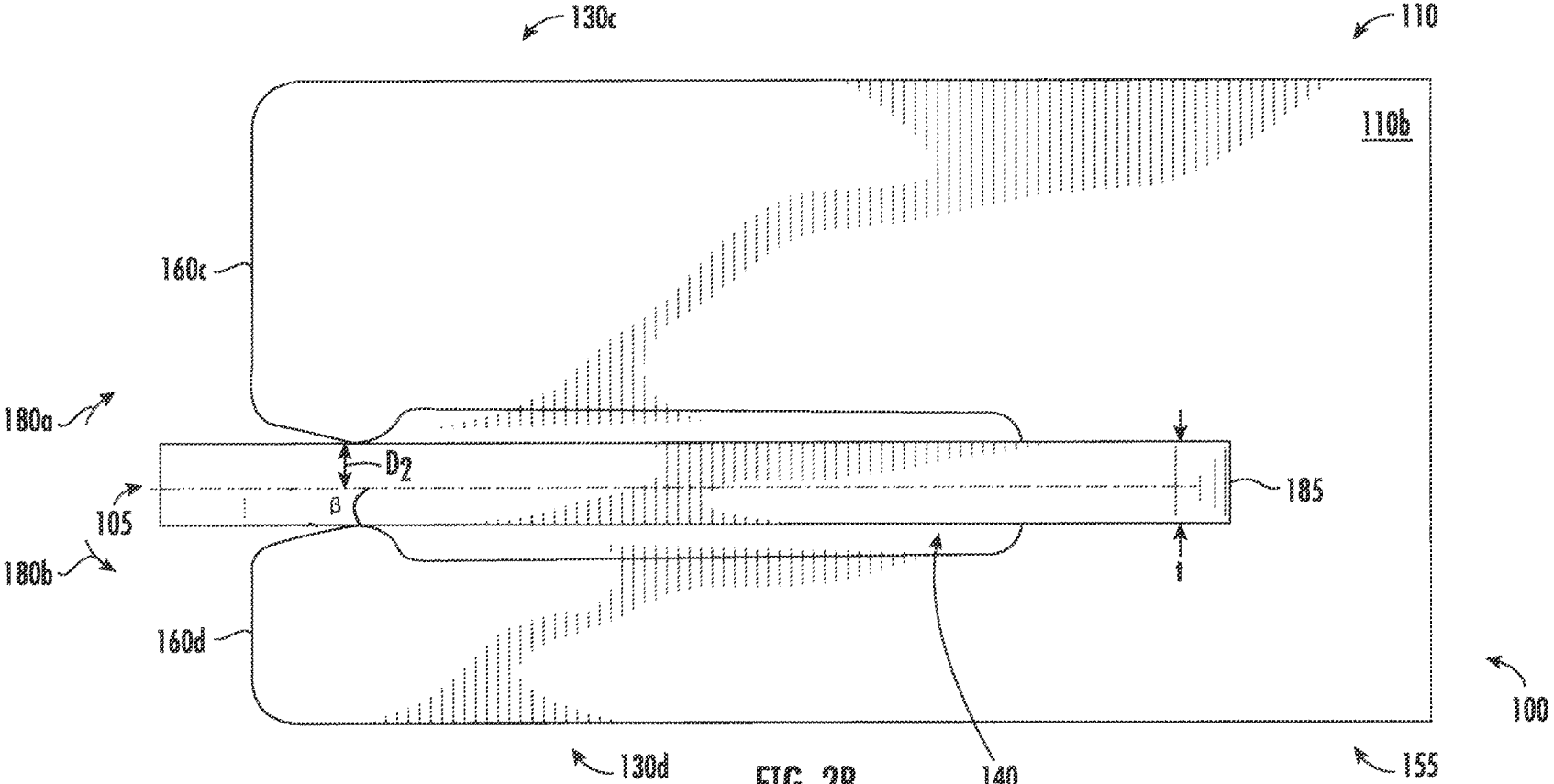
Figure 3A:
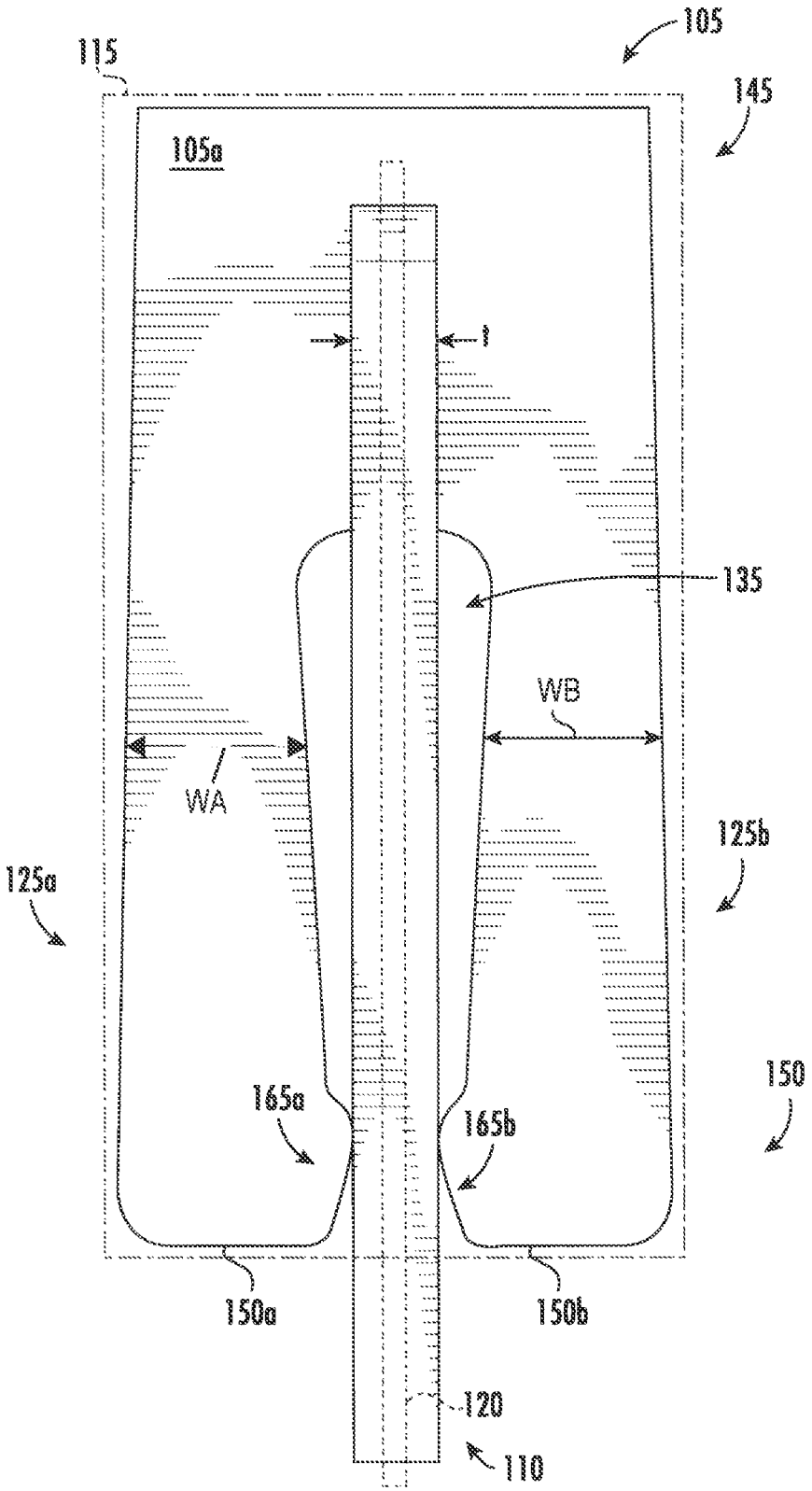
FIGS. 3A-3B are front and back views illustrating an exemplary embodiment of a first terminal end shown in FIG. 1.
Figure 3B:
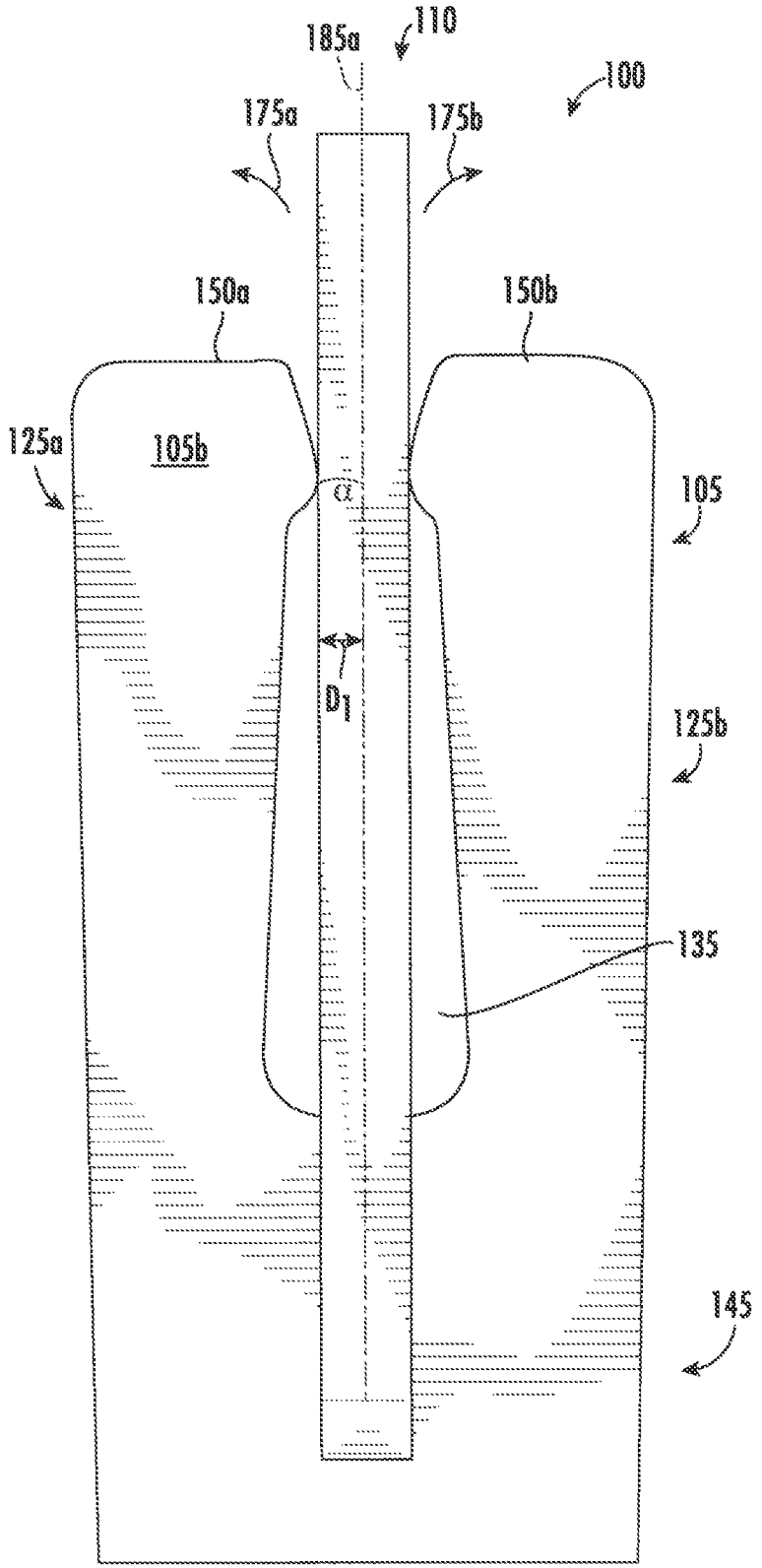
Figure 4A:
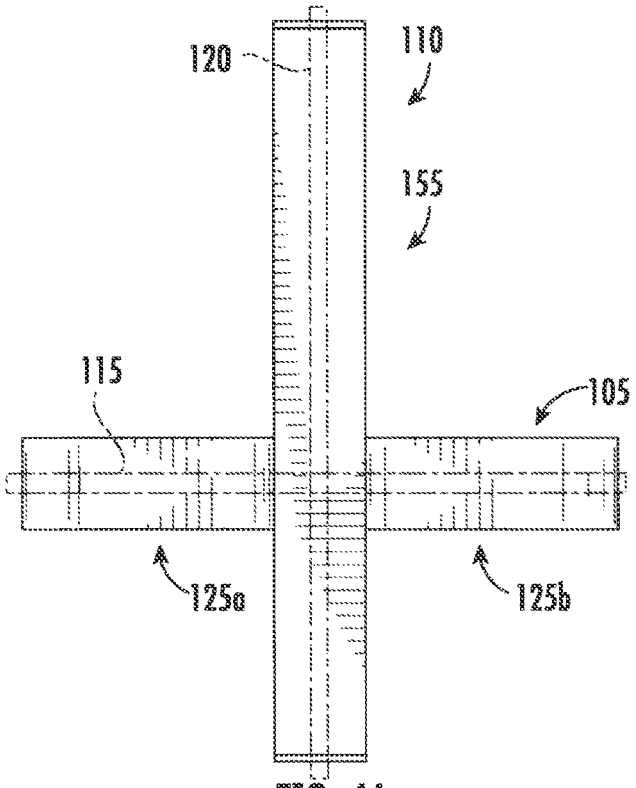
FIG. 4A-4B are top and bottom views illustrating an exemplary embodiment of the terminal system shown in FIG. 1.
Figure 4B:
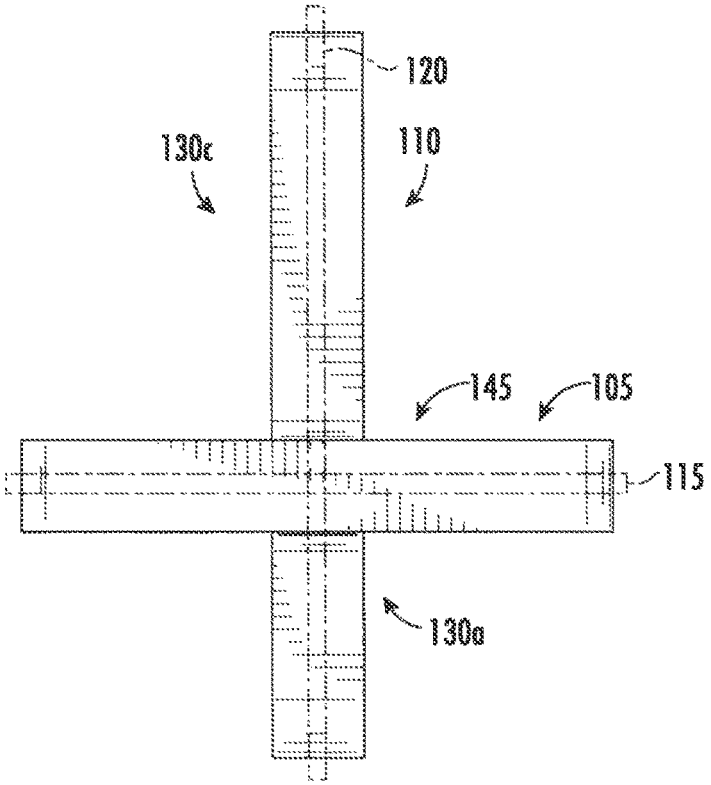

The present embodiments will now be described more fully hereinafter with reference to the accompanying drawings, in which several exemplary embodiments are shown. The subject matter of the present disclosure, however, may be embodied in many different forms and types of methods and devices, and should not be construed as limited to the embodiments set forth herein. Rather, these embodiments are provided so that this disclosure will be thorough and complete, and willfully convey the scope of the subject matter to those skilled in the art. In the drawings, like numbers refer to like elements throughout.

Referring to FIGS. 1-4B, an exemplary embodiment of a terminal system 100 is illustrated. A first tuning fork terminal end 105 may extend along a first plane 115. The first plane 115 may be substantially parallel to surfaces 105*a*, 105*b* of the first tuning fork terminal end 105. The first tuning fork terminal end 105 may have a plurality of fingers, or prongs 125, thereby forming a first gap 135. In some embodiments, the first tuning fork terminal end 105 may have a first prong 125*a* and a second prong 125*b*. Similarly, a second tuning fork terminal 110 may extend along a second plane 120. The second plane 120 may be substantially parallel to surfaces 110*a*, 110*b* of the second tuning fork. The second tuning fork terminal end 110 may have a plurality of fingers, or prongs 130, thereby forming a second gap 140. As will be described below, the first terminal end 105 and the second terminal end 110 may be assembled substantially perpendicular to each other, e.g., 90°±10°, such that the first gap 135 and the second gap 140 may be mated together, and the respective prongs may contact a surface of each terminal end. It is understood that side views of the respective planes 115, 120 (e.g., the first plane 115 in FIG. 2A, the second plane 120 in FIG. 3A) are shown as double lines for illustration purposes. As described above, this configuration may increase a number of electrical contact points in a system. This may save space in a larger electrical system, e.g., on a circuit board. When electrical current is conducted through the terminal ends, additional contact points may reduce a temperature of the system (and subsequently develop less heat in the system), and may have a lower resistance. Alternatively, a system in accordance with the present disclosure, e.g., having four contact points, may carry more current at a temperature similar to a two-point contact system.

The terminal ends 105, 110 may be formed of a conductive material, including but not limited to copper, copper alloys, stainless steel, and the like. The terminal end 105 may be formed of a same material, or of a different material, from terminal end 110. In embodiments, the terminal ends 105, 110 may be formed by stamping, laser cutting, or other known forming processes.

A first tuning fork terminal end 105 may include a first prong 125*a* and a second prong 125*b*, and a second tuning fork terminal end 110 may include a third prong 130*c* and a fourth prong 130*d*. The first tuning fork terminal end 105 may be formed on the first plane 115 and may extend from a first proximal end 145 to respective first distal ends 150 of each prong 125*a*, 125*b*. The second tuning fork terminal end 110 may be formed on the second plane 120 and may extend from a second proximal end 155 to respective second distal ends 160 of each prong 130*c*, 130*d*.

The tuning fork terminal ends 105, 110 may have a joined proximal end and individual prongs at a distal end, thereby forming a respective gap. In embodiments, the first and second prongs 125*a*, 125*b* may be joined together at the first proximal end 145 to form the first tuning fork terminal end 105, and the third and fourth prongs 130*c*, 130*d* may be joined together at the second proximal end 155 to form the second tuning fork terminal end 110. It is understood that a longer terminal length may result in a lower stress for a given gap deflection.

In some embodiments, one or more terminal ends may be configured offset from each other, as described co-pending application filed concurrently, entitled "Offset Tuning Fork Contact Terminals and Methods of Forming Thereof", which is herein incorporated by reference in its entirety.

The first, second, third, and fourth prongs 125*a*-125*b*, 130*c*-130*d* may have a width "W" and may be equal or different widths. In some embodiments, a width of a first prong 125*a* (e.g., "WA") may be different from a width of a second prong 125*b* (e.g., "WB"), and a width of a third prong 130*c* (e.g., "WC") may be different from a width of a fourth prong 130*d* ("WD"). In some embodiments, a width of the first and second prongs 125*a*, 125*b* may be equal to each other (e.g., W1), and a width of the third and fourth prongs 130*c*, 130*d* may be equal to each other (e.g., W2), and W1 and W2 may be different from each other. In some embodiments, a first terminal end 105 having prong widths different from a second terminal end 110 may be desirable for accommodating different connections.

In embodiments, the widths W of any of the first, second, third, and/or fourth prongs 125*a*-125*b*, 130*c*-130*d* may be constant from a proximal end to a distal end. In some embodiments, the widths W (e.g., W, W1, W2, WA, WB, WC, WD) of any of the first, second, third, and/or fourth prongs 125*a*-125*b*, 130*c*-130*d* may be variable (e.g., see WA, WB of FIG. 3A) from a proximal end to a distal end. For example, a width of a prong may be wider at a distal end than at a proximal end.

In some embodiments, a distal end 150*a* of a first prong 125*a* may have a first protrusion 165*a* and a distal end 150*b* of a second prong 125*b* may have a second protrusion 165*b*. Each protrusion 165*a*, 165*b* may be formed inward toward the first gap 135. A distal end 160*c* of a third prong 130*c* may have a third protrusion 170*c* and a distal end 160*d* of a fourth prong 130*d* may have a fourth protrusion 170*d*. Each protrusion 170*c*, 170*d* may be formed inward toward the second gap 140. The protrusions 165*a*-165*b*, 170*a*-170*b* may be any shape, including but not limited to curved, angled, chamfered, filleted, and/or grooved. The protrusions 165*a*-165*b*, 170*a*-170*b* may provide a contact surface for contacting the other terminal end 105, 110. For example, protrusions 165*a*, 165*b* of the first terminal end 105 may contact first and second surfaces 110*a*, 110*b* of the second terminal end 110, and protrusions 170*c*, 170*d* of the second terminal end 110 may contact first and second surfaces 105*a*, 105*b* of the first terminal end 105. In some embodiments, the protrusions 165*a*-165*b*, 170*a*-170*b* may be configured to receive the respective other terminal ends, such as including lead-in features for easier assembly. For example, the protrusions 165*a*, 165*b*, 170*c*, 170*d* may include a tapered lead-in. Contact resistance at the terminal ends may be determined by the force generated, the hardness of the material, or the material's electrical resistivity, or combinations thereof.

Figure 5:
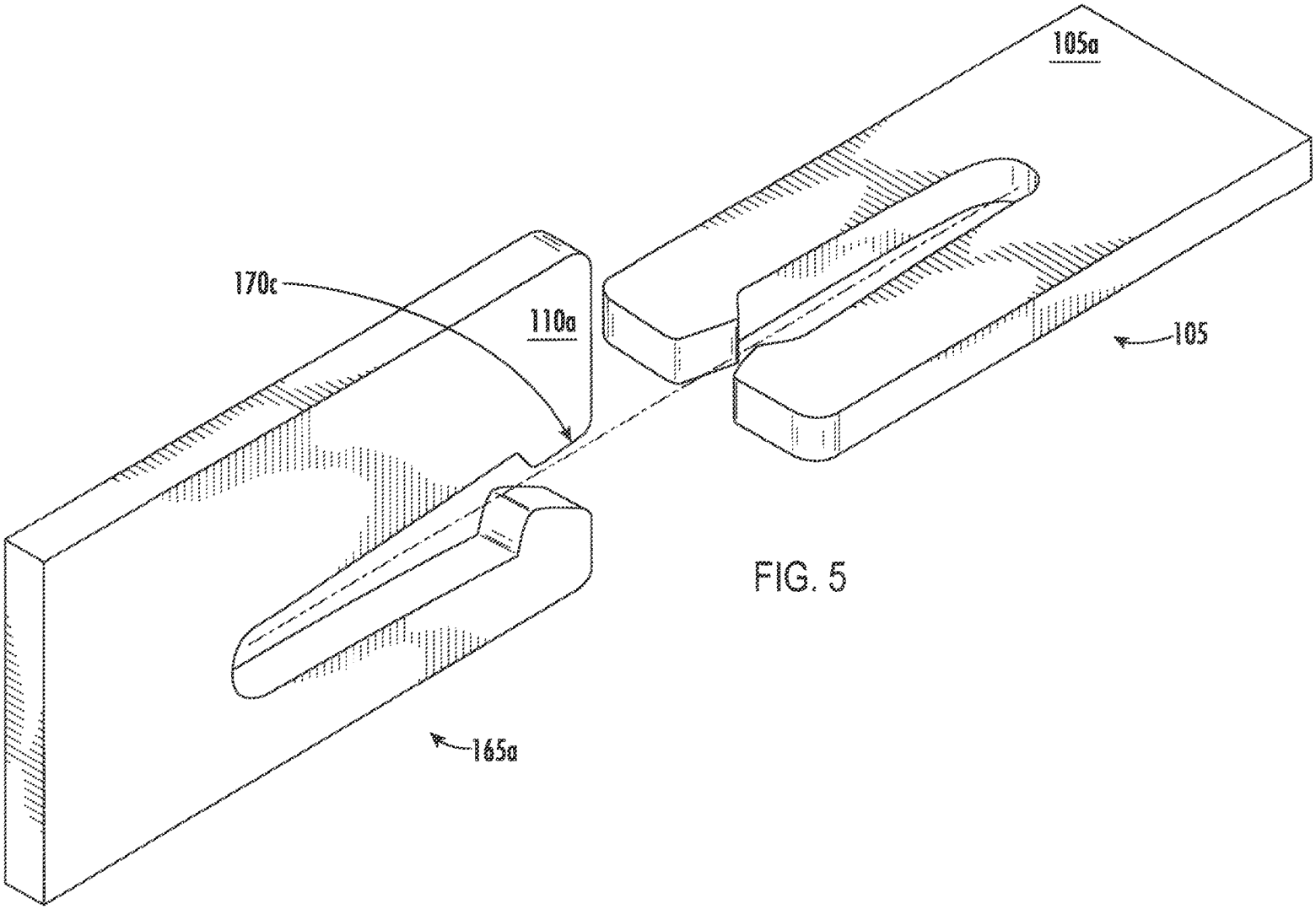
FIG. 5 illustrates an assembly of an exemplary embodiment of an exploded terminal system in accordance with the present disclosure.

Referring now to FIG. 5, an exemplary embodiment of the first and second terminal ends in an exploded view is shown. In an unassembled state, the first and second prongs 125*a*, 125*b* of the first terminal end 105 may be static relative to each other, and the third and fourth prongs 130*c*, 130*d* of the second terminal end 110 may be static relative to each other. In an assembled state, the first and second prongs 125*a*, 125*b* may be flexible to deflect away from each other and outward from the first gap 135 as indicated by arrows 175*a*, 175*b* to receive the corresponding second terminal end 110. The first and second prongs 125*a*, 125*b* may have a spring force such that when the second terminal end 110 is received in the first gap 135, the spring force of the first and second prongs 125*a*, 125*b* may maintain the second terminal end 110 in the first gap 135. Similarly, the third and fourth prongs 130*c*, 130*d* may be flexible to deflect away from each other and outward from the second gap 140 as indicated by arrows 180*a*, 180*b* to receive the corresponding first terminal end 105. The third and fourth prongs 130*c*, 130*d* may have a spring force such that when the first terminal end 105 is received in the second gap 140, the spring force of the third and fourth prongs 130*c*, 130*d* may maintain first terminal end 105 in the second gap 140.

In embodiments, when the first, second, third, and/or fourth prongs 125*a*, 125*b*, 130*c*, 130*d* deflect outward from the respective first and second gaps 135, 140, a first angle α may be formed between a first center line 185*a* of the first gap 135, and a second angle β may be formed between a second center line 185*b* of the second gap 140. The first and second angles α, β may be near right angles, for example, 90°±10°. In some embodiments, the angles of deflection of the prongs 125*a*, 125*b*, 130*c*, 130*d* may be sized to balance a stress or force generated. The first and second tuning fork terminal ends 105, 110 may have a thickness "t", and may be equal or different thicknesses from each other. In embodiments, the thickness "t" may be greater than at least a portion of the first gap 135 and/or the second gap 140, e.g., at the respective protrusions 165*a*, 165*b*, 170*c*, 170*d*. Thus, contact between the respective prongs and terminal end surfaces may be assured, In some embodiments, contact may be staggered between the first terminal end 105 and the second terminal end 110. For example, a distance "d1" from the center line 185*a* of the first gap 135 to the first and second protrusions 165*a*, 165*b* may be different from a distance "d2" from the center line 185*b* of the second gap 140 to the third and fourth protrusions 170*c*, 170*d*. Thus, when assembled, e.g., by an insertion force, to connect the respective prongs such that the first and second gaps 135, 140 are mated, the contact between the protrusions and respective surfaces may be staggered. Staggered contact may be beneficial because to avoid or minimize deflection of both gaps at the same time. An increased deflection may increase the maximum insertion force. By staggering the contact lengths, both gaps may interface at different times, so the induced forces may not be additive. The staggered engage time resulting from the varied gap lengths may provide a reduction in the initial engagement force of the two tuning fork terminals. The initial engagement force of the terminals may be the largest resistance force and may be higher than a "sliding" force between the terminal contacts. By separating the initial contact force by staggered insertion, the overall maximum engagement force may be reduced, thereby allowing for an improved insertion force of the terminals.

As used herein, references to "an embodiment," "an implementation," "an example," and/or equivalents is not intended to be interpreted as excluding the existence of additional embodiments also incorporating the recited features.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize its usefulness is not limited thereto and the present disclosure can be beneficially implemented in any number of environments for any number of purposes. Thus, the claims set forth below are to be construed in view of the full breadth and spirit of the present disclosure as described herein.

What is claimed is:

1. A system for increasing terminal electrical contact, comprising:

a first tuning fork terminal end extendable on a first plane and including a first prong and a second prong both extending from a joined first end to respective distal ends and forming a first gap therebetween;

a second tuning fork terminal end extendable on a second plane and including a third prong and a fourth prong both extending from a joined second end to respective distal ends and forming a second gap therebetween;

wherein the first plane and the second plane are substantially perpendicular; and wherein the distal ends of the first and second prongs are configured to contact the second end of the second tuning fork, and the distal ends of the third and fourth prongs are configured to contact the first end of the first tuning fork.

2. The system according to claim 1, wherein the first gap at the distal ends of the first and second prongs has a width smaller than a thickness of the second tuning fork, and wherein the second gap at the distal ends of the third and fourth prongs has a width smaller than a thickness of the first tuning fork.

3. The system according to claim 1, wherein the first prong and the second prong are flexible to deflect away from each other such that the first gap is enlarged for receiving the second tuning fork terminal, wherein a first spring force maintains the second tuning fork terminal in the first gap between the first and second prongs.

4. The system according to claim 1, wherein the third prong and the second prong are flexible to deflect away from each other such that the second gap is enlarged for receiving the first tuning fork terminal, wherein a second spring force maintains the first tuning fork terminal in the second gap between the third and fourth prongs.

5. The system according to claim 1, further comprising a first protrusion disposed on a distal end of the first prong and extending towards the first gap, and a second protrusion disposed on the distal end of the second prong and extending toward the first gap.

6. The system according to claim 5, further comprising a third protrusion disposed on the distal end of the third prong and extending toward the second gap, and a fourth protrusion disposed on the distal end of the second prong and extending toward the second gap.

7. The system according to claim 6, wherein a distance from a centerline of the first gap to the protrusions of the first and second prongs for contacting the second tuning fork is different from a distance from a centerline of the second gap to the protrusions of the third and fourth prongs for contacting the first tuning fork.

8. The system according to claim 7, wherein contact between the first tuning fork and the second tuning fork is staggered during insertion.

9. The system according to claim 1, wherein the first prong, second prong, third prong, fourth prong, or combinations thereof, has a constant width.

10. The system according to claim 1, wherein the first prong, second prong, third prong, fourth prong, or combinations thereof, has a variable width.

11. A method for increasing terminal electrical contact, comprising:

attaching a first tuning fork terminal to a second tuning fork terminal, wherein:

the first tuning fork terminal includes a first prong and a second prong both extending from a joined first end to respective distal ends and forming a first gap therebetween;

the second tuning fork terminal includes a third prong and a fourth prong both extending from a joined second end to respective distal ends and forming a second gap therebetween; and the first and second gaps being configured such that the first tuning fork terminal is insertable substantially perpendicular with respect to the second tuning fork terminal; and wherein the distal ends of the first and second prongs are configured to contact the second end of the second tuning fork, and the distal ends of the third and fourth prongs are configured to contact the first end of the first tuning fork.

12. The method according to claim 11, wherein the first gap at the distal ends of the first and second prongs has a width smaller than a thickness of the second tuning fork, and wherein the second gap at the distal ends of the third and fourth prongs has a width smaller than a thickness of the first tuning fork.

13. The method according to claim 11, wherein the first prong and the second prong are flexible to deflect away from each other such that the first gap is enlarged for receiving the second tuning fork terminal, wherein a first spring force maintains the second tuning fork terminal in the first gap between the first and second prongs.

14. The method according to claim 11, wherein the third prong and the second prong are flexible to deflect away from each other such that the second gap is enlarged for receiving the first tuning fork terminal, wherein a second spring force maintains the first tuning fork terminal in the second gap between the third and fourth prongs.

15. The method according to claim 11, wherein a first protrusion is disposed on the distal end of the first prong and extending toward the first gap, and a second protrusion is disposed on the distal end of the second prong and extending toward the first gap.

16. The method according to claim 15, wherein a third protrusion is disposed on the distal end of the third prong and extending toward the second gap, and a fourth protrusion is disposed on the distal end of the second prong and extending toward the second gap.

17. The method according to claim 16, wherein a distance from a centerline of the first gap to the protrusions of the first and second prongs for contacting the second tuning fork is different from a distance from a centerline of the second gap to the protrusions of the third and fourth prongs for contacting the first tuning fork.

18. The method according to claim 17, wherein contact between the first tuning fork and the second tuning fork is staggered during insertion.

19. The method according to claim 11, wherein the first prong, second prong, third prong, fourth prong, or combinations thereof, has a constant width.

20. The method according to claim 11, wherein the first prong, second prong, third prong, fourth prong, or combinations thereof, has a variable width.

* * * * *